US006098819A

United States Patent [19]

Link

[11] Patent Number: 6,098,819

[45] **Date of Patent: *Aug. 8, 2000**

[54] MAGAZINE FOR PIPETTE TIPS

[75] Inventor: Holger Link, Hamburg, Germany

[73] Assignee: Eppendorf-Netheler-Hinz GmbH, Hamburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/131,813

[22] Filed: Aug. 10, 1998

[30] Foreign Application Priority Data

Sep. 26, 1997 [DE] Germany ..... 197 42 493

[51] Int. Cl.[7] ..... A47F 7/28; B01L 3/02

[52] U.S. Cl. ..... 211/85.13; 206/504; 422/100; 211/60.1; 211/194

[58] Field of Search ..... 211/85.13, 60.1, 211/74, 126.2, 126.1, 194; 206/499, 486, 505–509, 443, 446, 562–563, 504; 422/99–102, 104; 403/326, 329

[56] References Cited

U.S. PATENT DOCUMENTS

| | | | |
|---|---|---|---|
| 3,398,840 | 8/1968 | Wilson | 211/126.2 |
| 3,405,810 | 10/1968 | Rogus | 211/126.2 |
| 3,534,866 | 10/1970 | Asenbauer | 211/126.2 |
| 4,113,329 | 9/1978 | Thurman | 211/126.2 |
| 4,160,803 | 7/1979 | Potts . | |
| 4,284,603 | 8/1981 | Korom | 211/74 |
| 4,349,109 | 9/1982 | Scordato et al. | 206/499 |
| 4,495,150 | 1/1985 | Cook et al. | 211/74 |
| 4,527,707 | 7/1985 | Heymann | 211/74 |
| 4,759,451 | 7/1988 | Apps | 211/126.2 |
| 5,169,603 | 12/1992 | Landsberger | 211/74 |
| 5,366,088 | 11/1994 | Hill et al. | 206/499 |
| 5,392,914 | 2/1995 | Lemieux et al. . | |
| 5,441,702 | 8/1995 | Lemieux et al. . | |
| 5,579,929 | 12/1996 | Schwartz | 211/74 |
| 5,642,816 | 7/1997 | Kelly et al. | 211/60.1 |

FOREIGN PATENT DOCUMENTS

| | | |
|---|---|---|
| 7244356 | 12/1972 | Germany . |
| 9216674 | 4/1993 | Germany . |
| 4419291 | 12/1995 | Germany . |
| 4425277 | 1/1996 | Germany . |
| 9421735 | 8/1996 | Germany . |

*Primary Examiner*—Daniel P. Stodola
*Assistant Examiner*—Jennifer E. Novosad
*Attorney, Agent, or Firm*—Brown & Wood, LLP

[57] ABSTRACT

A magazine for pipette tip-shaped articles including a plurality of plates for holding the pipette tip-shaped articles and each having a plurality of bores for receiving the pipette tip-shaped articles in their entirety, a plurality of racks stacked over one another and adapted to each receive at least one holding plate, and complementary locking elements provided on the adjacent racks, respectively, and engageable with each other to form the at least one of a form-locking connection and a force-locking connection upon insertion of a holding plate in one of the adjacent racks and disengageable from each other upon removal of the holding plate.

13 Claims, 5 Drawing Sheets

MAGAZINE FOR PIPETTE TIPS

BACKGROUND OF THE INVENTION

The invention relates to a magazine for pipette tips or other commodity goods.

Relevant magazines for pipette tips which serve for retaining and keeping ready pipette tips for use are known. These have holding plates with receptacles ("trays") into which pipette tips are inserted from above, wherein the pipette tips on account of a diameter widening upwardly or by way of a collar do not fall through. A pipetting device may with an insert-cone be pressed into a pipette tip from above and this may then be removed with the pipetting device. After use the tip can be inserted into the same or into another holding plate in order then to be disposed of with further tips.

The magazines considered here have several holding plates which in each case are arranged in a rack which for the space-saving keeping of a multitude of pipette tips are stacked over one another. For use it is important that the racks on contact do not fall apart in an uncontrolled manner. Rather the racks should be able to be sequentially removed when the pipette tips of the contained holding plate are used up. With known systems the connections of the racks are created with a non-positive and frictional fit. The joining and separating forces are heavily dependent on tolerances.

BRIEF SUMMARY OF THE INVENTION

Proceeding from this it is the object of the present invention to provide a magazine for, pipette tips or other commodity goods with racks and holding plates with which the racks have a secure connection and may easily be separated from one another in the desired sequence without an uncontrolled falling apart.

The object is achieved by a magazine with the features of claim 1. Advantageous formations of the magazine are specified in the dependent claims.

The magazine according to the invention for pipette tips or other commodity goods has several racks stacked over one another. In the racks there are arranged holding plates with receptacles for the pipette tips. Preferably the holding plates may be inserted from above into the rack. With this the holding plates may be supported on consoles of the racks. At least one locking element of a rack by way of a holding plate inserted into this rack is brought into a non-positive or positive fit connection with an associated locking element of a rack arranged thereunder and the non-positive and/or positive fit connection is releasable by removing the holding plate. Preferably the locking element is sprung (by an additional spring or its own spring effect) so that against the effect of the spring system it moves into non-positive and/or positive fit connection with the, associated locking element and is releasable by removing the holding plate, under the effect of the spring system. With the sprung locking element it is the case preferably of a sprung tab which on one end has a connection to the rack and on the other end comes into engagement with the associated locking element. At the same time the sprung tab above may have the connection to the rack and laterally on a main section comprise an inclination via which the side of the holding plate, on inserting into the rack, slides into the tab under spring deflection. For a secure locking the sprung tab on the other end may have a hook which on spring deflection of the tab grips under an upper region of a hook receiver. With this the hook receiver may be located in a sprung tab of the rack arranged thereunder, this rack being arranged downwards for a simplified engagement of the hook.

With the magazine according to the invention thus the racks are connected to one another in a non-positive and/or positive fit by way of an inserted holding plate and the non-positive and/or positive connection is released by removing the holding plate. As a result of this the secure holding together of the magazine is ensured and after working off one layer, tips may be separated from the stack by way of merely removing the uppermost holding plate(s) of the uppermost rack and the rack lying thereunder may be laid free with fresh pipette tips.

As a rule the racks are securely held together when the holding plates are inserted into the rack without special securing. A non-positive fit securement of the holding plates is possible, e.g. by way of the springing of the locking element which acts on the sides of the holding plates. Preferably however the holding plate is releasably locked via at least one further non-positive or positive fit locking element with at least one associated further locking element of the rack accommodating the holding plate. Preferably the further locking element is a sprung locking tab whose lower end has a connection to one side of the holding plate which with an outer locking projection grips behind an upper edge of a projection receiver of the rack, wherein the locking tab with an upper actuating end projects beyond the rack and engages into a rack where appropriate arranged above this. By actuating the actuating end against the spring system, the engagement of the locking tab into the projection receiver may be released and then the holding plate may be removed from the rack.

Basically the rack may only on one side have a sprung tab for connecting to the rack lying thereunder and be connected to this on the other side in another manner, for example by meshing in the edge region. Preferably however the rack on opposite sides of the holding plate has sprung tabs. The secure connection of racks arranged over one another may then be effected by the mere insertion of a holding plate which actuates both sprung tabs and the unlocking of both tabs is possible by merely removing the holding plate.

Also the securing of the holding plate may be effected on only one side thereof via locking element provided thereon and form- and/or forcelockingly and releasably engaged with corresponding locking elements provided on a respective rack. Preferably however, the holding plate on. sides lying opposite one another has further locking elements. If these are designed as further locking tabs the holding plate may be released and removed from the rack with only one hand by pressing the locking tabs together.

Preferably in the racks next to one another there are arranged two holding plates. Locking elements may be located next to the corners of the rack. The further locking elements of the holding plate are preferably arranged between the locking elements of the rack. As materials for the rack and/or the holding plate in particular polypropylene, polyethylene, polymethacrylate and/or polycarbonate are to be considered.

DETAILED DESCRIPTION OF THE INVENTION

Figure 1:
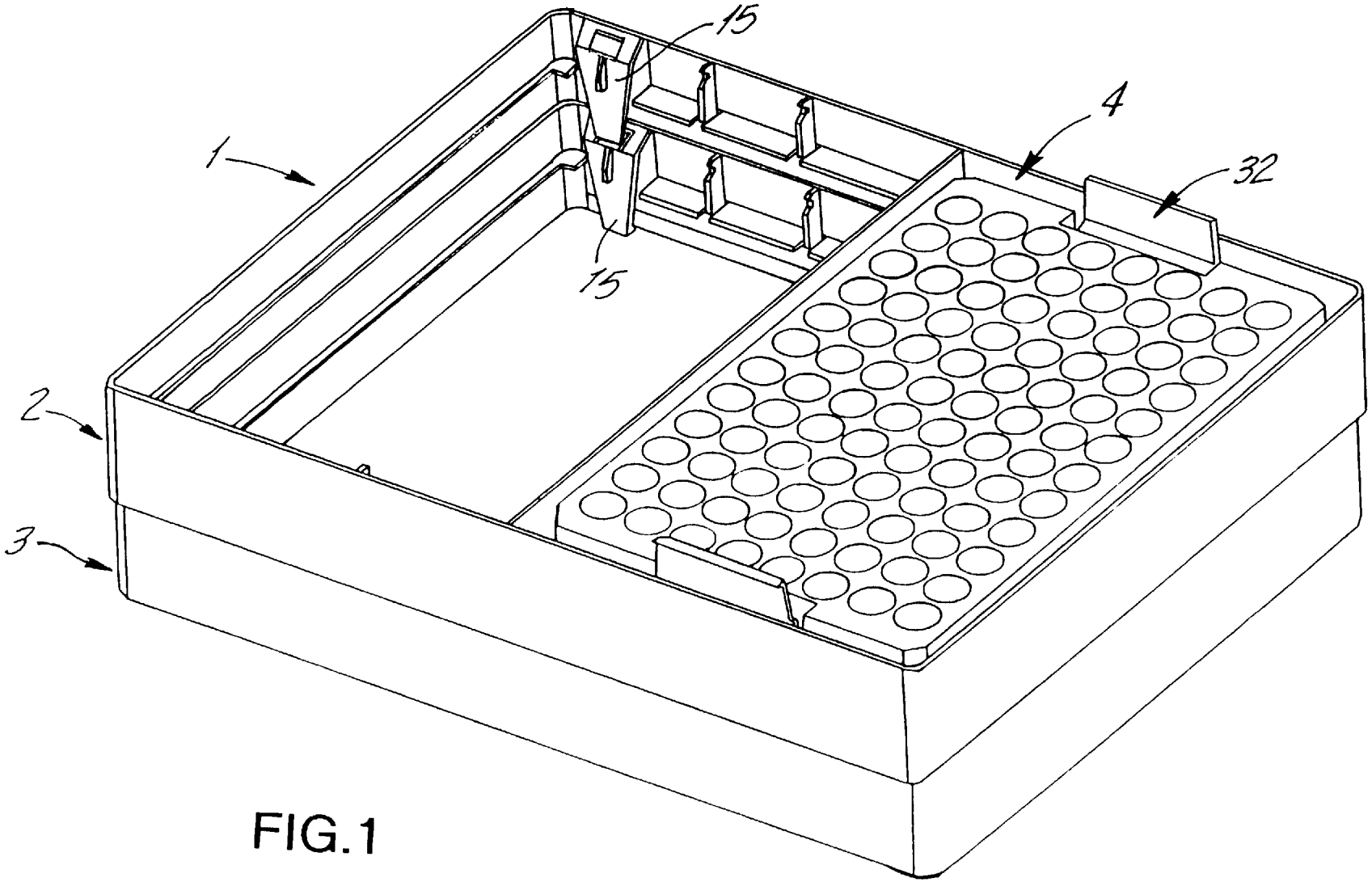
Figure 2:
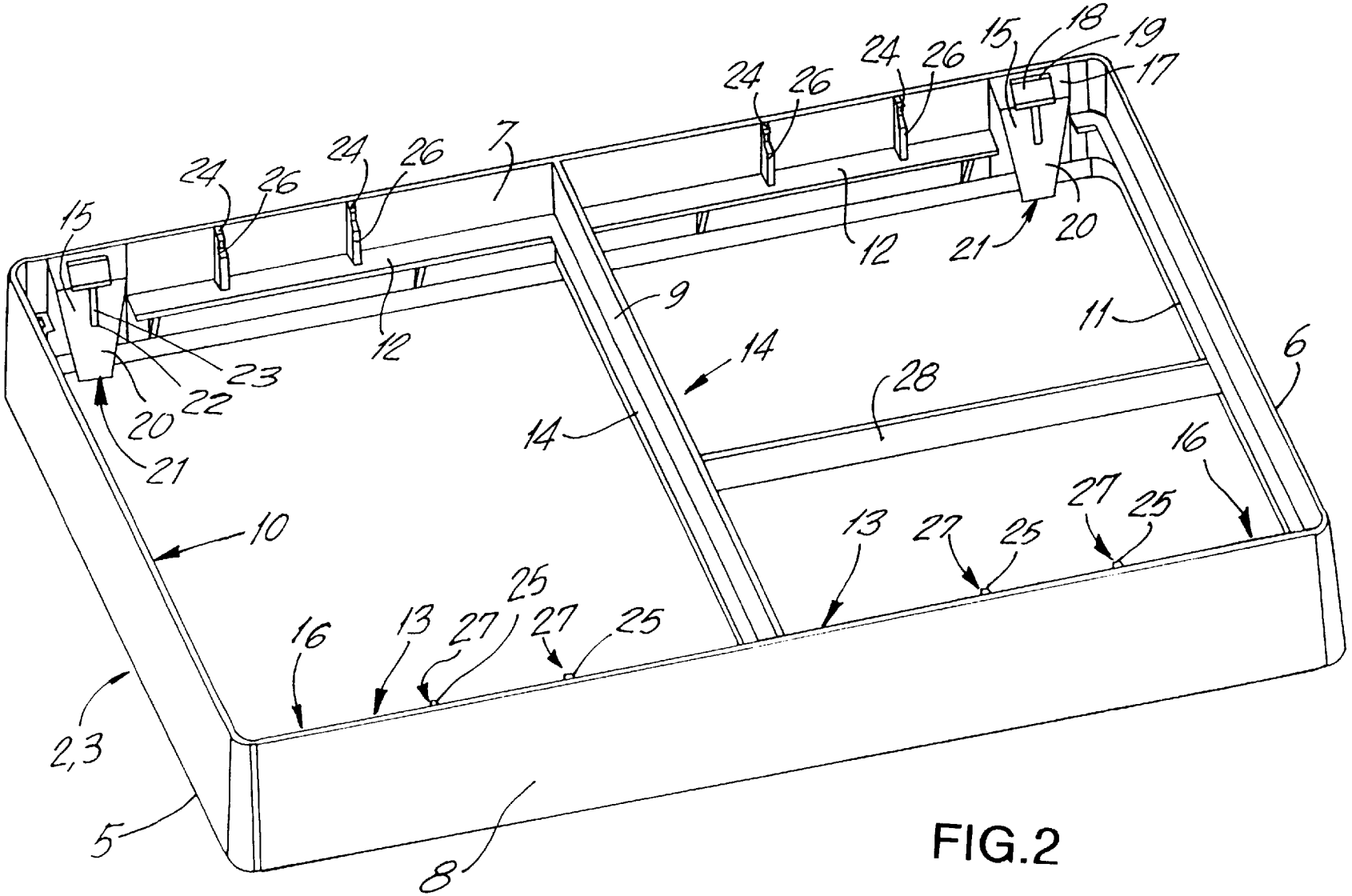
Figure 3:
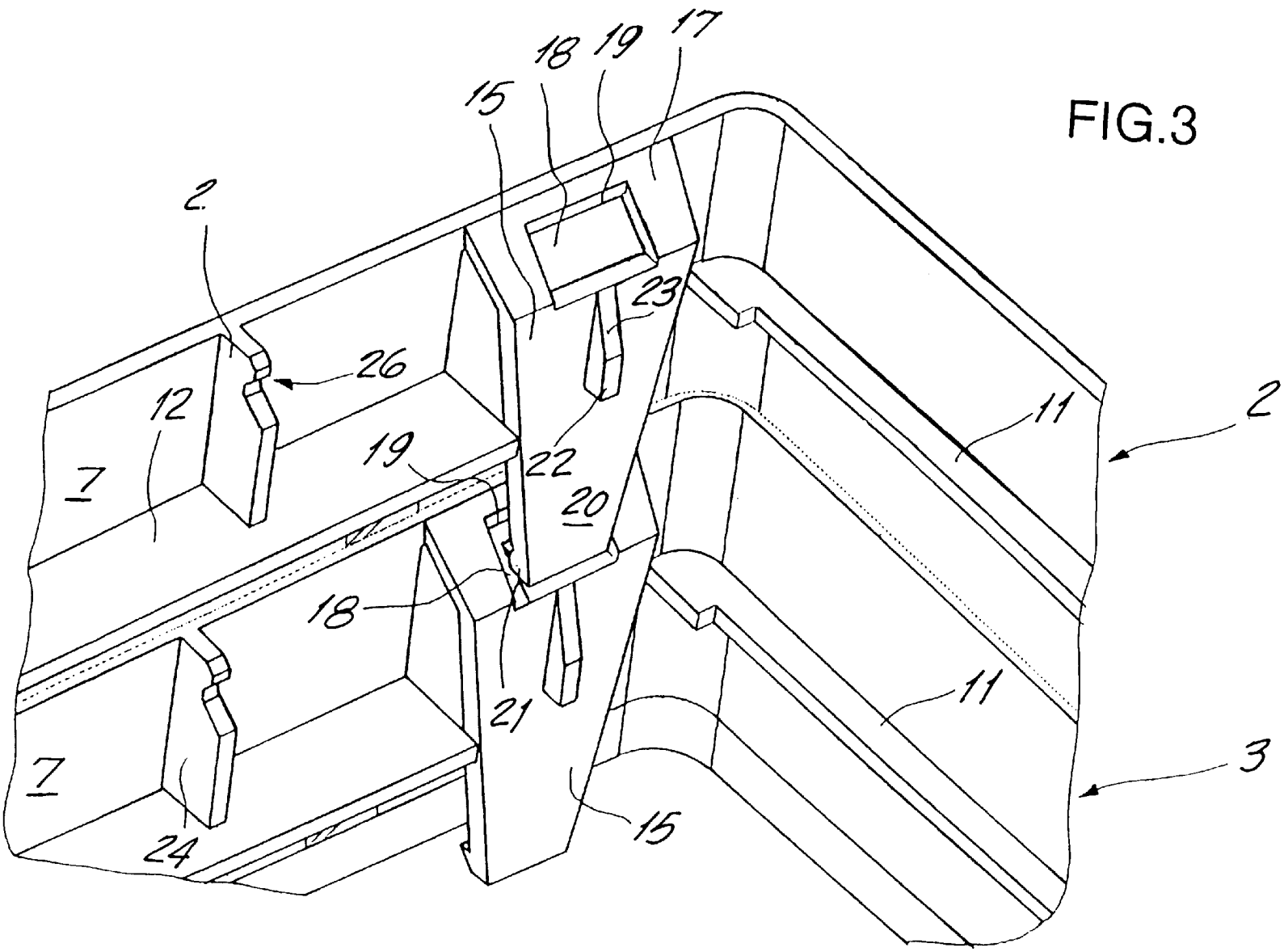
Figure 4:
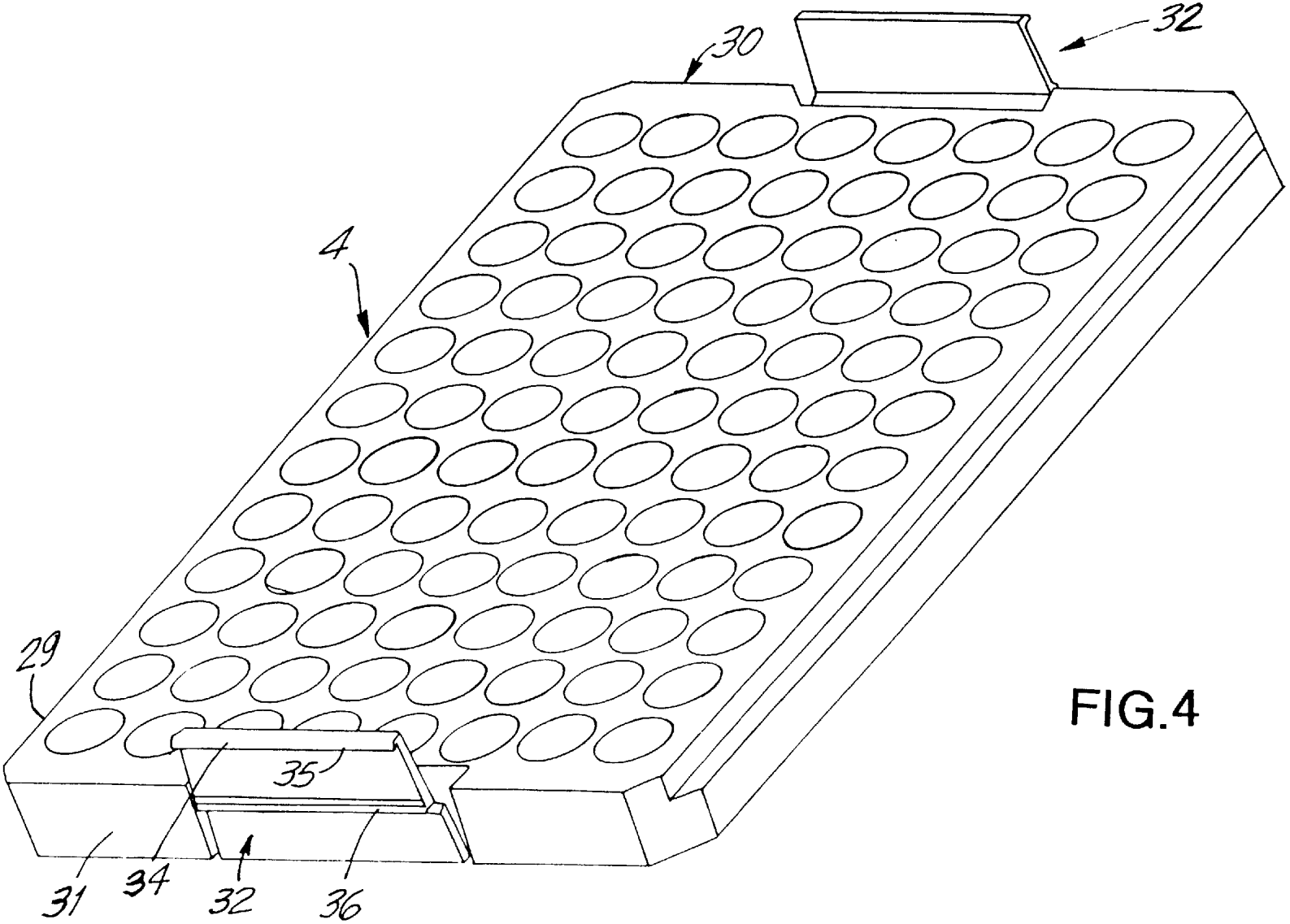
Figure 5:
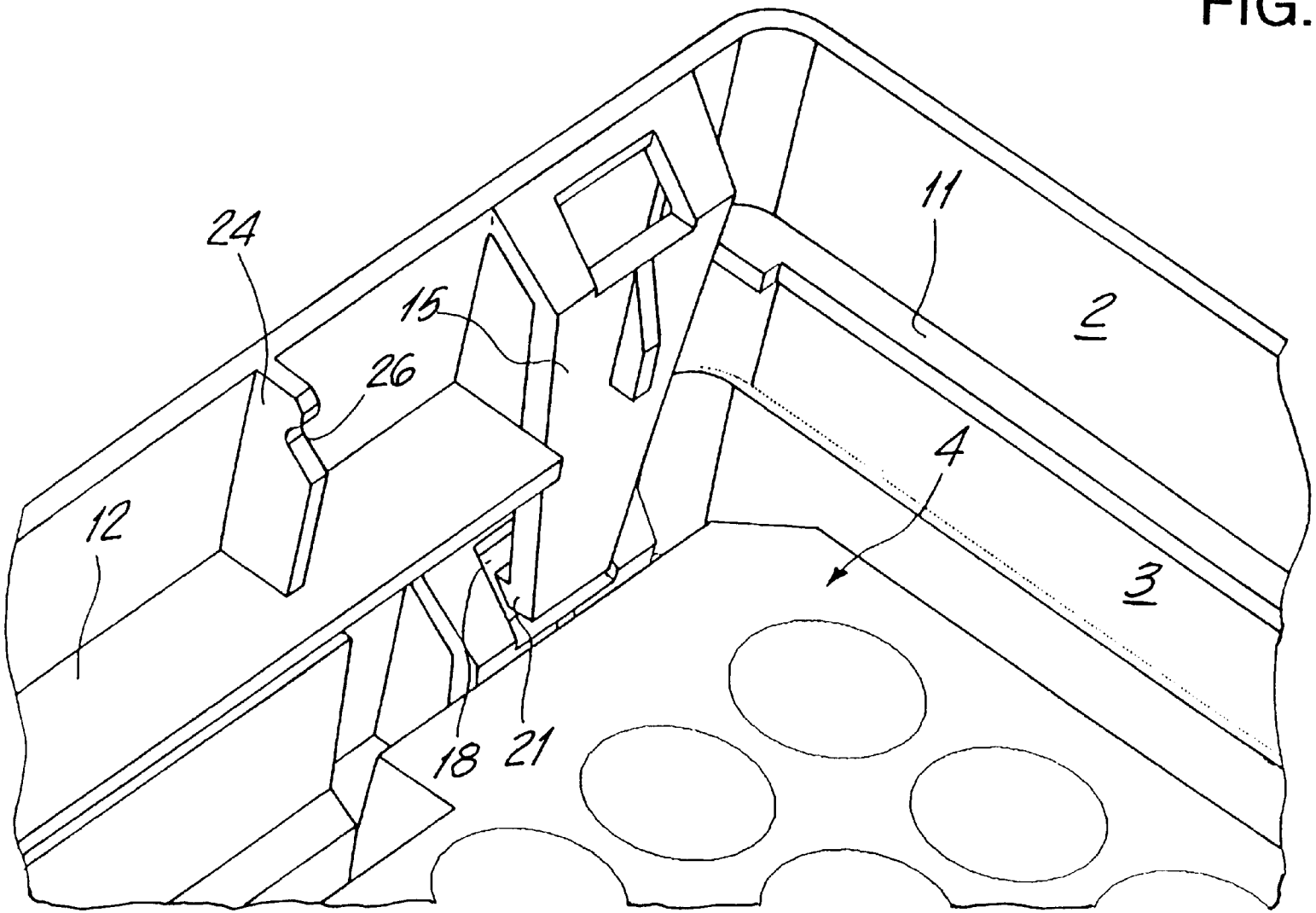

One embodiment example of the invention is hereinafter described with reference to the accompanying drawings. In the drawings there is shown:

FIG. 1 a magazine with two racks and an inserted holding plate in a perspective view from above right, FIG. 2 a rack of the same magazine in a perspective view from above left, FIG. 3 a corner region of two racks set into one another, of the same magazine, in an enlarged perspective view from above left;

FIG. 4 a holding plate of the same magazine in an enlarged perspective from above right;

FIG. 5 the corner region according to FIG. 3 with a holding plate inserted into the lower rack, in the same perspective.

DETAILED DESCRIPTION OF THE INVENTION

According to FIG. 1 the magazine 1 has two racks 2, 3 stacked over one another, wherein in each stack there may be inserted two holding plates 4, of which one is shown in the upper rack 2.

According to FIG. 2 each rack 2, 3 has two short lateral walls 5, 6 and two long lateral walls 7, 8, wherein the long lateral walls in the middle are spanned by a central web 9. On the inner side of the lateral walls 5, 6, 7, 8 and on both sides of the central web roughly at half the height there are located consoles 10 to 14. With this the consoles are interrupted next to the corners of the racks 2, 3 and here there are located resilient tabs 15, 16.

The tabs 15, 16 are formed identically and above have—as can be better deduced from FIG. 3—an inclined wall 17 which represents a connection to the long lateral walls 7, 8. In the inclined wall 17 there is located a hook receiver 18 which is limited by an upper edge 19 which is placed somewhat below the transition of the inclined wall 17 into the long lateral wall 7, 8. Below the inclined wall 17 the tabs 15, 16 have a trapezoidal main section 20 which reaches up to below the lower edge of the rack 2, 3. Here there is present a hook 21 directed to the respective long lateral wall 7, 8. Bordering the hook receiver 18 the main section 20 carries a rib 22 which faces the inner space of the rack 2, 3 and which comprises an inclination 23.

Furthermore each long lateral wall 7, 8 between the short lateral wall 5, 6 and the central web 9 has two vertical inwardly projecting ribs 24, 25 which on the inner edge comprises a roughly C-shaped notch 26, 27 accessible from the outside.

Finally the racks 2, 3 have a longitudinal web 28 which connects the central web 9 and the short lateral wall 6 to one another below the consoles 14, 11.

According to FIG. 3 with the racks 2, 3 placed over one another, the resilient tabs 15, 16 of the upper rack 2 are arranged such that they are arranged with their hooks 21 on the level of the hook receivers 18 of the lower rack 3 and on pivoting the tabs 15, 16 of the upper rack 2, with their hook ends 21 they just about grip under the upper edge 19 of the hook receivers 18 of the lower rack 3. The dimensioning may be effected such that a non-positive/positive fit connection of the racks 2, 3 is achieved which compensates changes in measurements on autoclaving the magazine parts.

According to FIG. 4 a holding plate 4 is formed essentially rectangular and is provided with 8×12 through-bores transverse to the plate plane which form receptacles for pipette tips to be inserted from above. The pipette tips which are not shown are retained in the receptacles 29 on account of their conical base shape and/or an edge bulge at their upper end.

On their opposite narrow sides 30, 31 the holding plate 4 in each case has a resilient locking tab 32 which at its lower end is connected to the respective narrow side 30, 31 and which comprises roughly at the centre or on the level of the upper side of the holding plate 4 an outwardly projecting locking rib 33 which is aligned parallel to the holding plate 4. Further the resilient locking tabs 32 protrude with an actuating end 34 beyond the upper side of the holding plate 4. Here they have a bulge 35 for a pleasant grip.

Racks 2, 3 and holding plates 4 may in each case be injected as one piece from plastic.

FIGS. 1 and 5 show the magazine with two racks 2, 3 which in each case is partly equipped with holding plates 4. The holding plates 4 at the same time with their locking ribs 33 engage into the notches 26, 27 of the racks. In this locking position they are held by the spring effect of their locking tabs 32. The holding plates 4 may be pulled from the respective uppermost rack 2 (cf. FIG. 1) in that the actuating end 34 of the locking tabs 32, which project beyond this rack, are slightly pressed together so that the locking ribs 33 are pivoted against the spring effect of the locking tabs 32 out of the notches 26, 27. Then the respective holding plate 4 may be pulled upwards out of the rack 2 (cf. FIG. 5). In FIG. 5 it is also shown that the actuating ends 34 of the holding plate 4 reach out of the lower rack 3 into the upper rack 2 up to the consoles 12, 13. In the reverse direction the insertion is effected with a slight pressing together of the locking tabs 32 which after releasing engage into the notches 26 under their spring effect. A locking into place may also be effected by merely pressing the holding plate 4 from above into the rack 2, wherein the locking tabs 32 are pressed together by the oblique upper edge of the ribs 24, 25.

On insertion, the respective holding plate with its narrow side 30, 31 slides over the ribs 22 with the inclinations 23 of the resilient tabs 15, 16 of the respective compartment of the rack 2 concerned by which means the tabs 15, 16 are spread apart. At the same time the tabs 15, 16 of the upper rack 2 engage with their hooks 21 into the receptacles of the lower rack 3. As a result of this the two racks 2, 3 are locked with one another (cf. FIG. 1). On removing the holding plate 4 the tabs 15, 16 spring back into their eased position and the locking of the hooks 21 is released (cf. FIG. 5). Only when both holding plates 4 are removed from the upper rack 2 may this be separated from the lower rack 3.

After removing the unlocked rack 2 the pipette tips in the holding plates 4 of the rack 3 lying thereunder are accessible for use.

Any number of racks 2, 3 may be stacked onto one another. The lowest rack (stack base) where appropriate has no lower projecting tabs 15, 16 for a stable standing.

What is claimed is:

1. A magazine for pipette tip-shaped articles, comprising:

a plurality of plates for holding the pipette tip-shaped articles and each having a plurality of bores for receiving and retaining the pipette tip-shaped articles therein;

a plurality of racks stacked over one another and adapted to each receive at least one holding plate; and means for formlockingly connecting adjacent racks and including complementary locking elements provided on the adjacent racks, respectively, and engageable with each other upon insertion of one of the holding plates in one of the adjacent racks and disengageable from each other upon removal of the holding plate, wherein each of the complementary locking elements is formed as a resilient tab having one end thereof connected with a respective one of the adjacent racks and formed as a hook receiver having an upper edge, another end thereof formed as a hook, and having an inclined surface, wherein upon connection of the adjacent racks, the hook of a resilient tab connected with one of the adjacent racks grips under the upper edge of the hook receiver of a resilient tab connected with another of the adjacent racks, and wherein the holding plates upon insertion in the one of the adjacent racks, slides along the inclined surface of the resilient tab connected with the one of the adjacent racks, resiliently deflecting the hook of the resilient tab into engagement with the hook receiver of the resilient tab connected with another of the adjacent racks.

2. The magazine according to claim 1, wherein each of the plurality of racks has console means for supporting at least one holding plate.

3. The magazine according to claim 1, wherein each of the plurality of racks has an additional locking element, and at least one holding plate has an associated locking element engageable with the additional locking element of the rack upon insertion of the at least one holding plate in the rack.

4. The magazine according to claim 3, wherein the additional locking element is formed as a projecting member having an upper edge, and the associated locking member of the holding plate is formed as a resilient tab having a lower end engaging a side of the holding plate at which the resilient tab is provided, an outer locking projection for gripping behind the upper edge of the projecting member provided on the rack, and an upper activating end projecting above the rack when the at least one holding plate is inserted into the rack, and adapted to engage a rack located above the rack in which the at least one holding plate is received.

5. The magazine according to claim 4, wherein the locking projection is formed as a locking rib extending parallel to the holding plate.

6. The magazine according to claim 5, wherein the projecting member, which forms the additional locking element of the rack, comprises at least one rib projecting from a lateral wall of the rack perpendicular thereto and having a notch formed at an inner edge thereof.

7. The magazine according to claim 6, wherein the additional locking element comprises two projecting ribs cooperating with the associated locking element of the at least one holding plate.

8. The magazine according to claim 3, wherein the holding plate includes two associated locking elements provided on opposite sides of the holding plate.

9. The magazine according to claim 1, wherein the complementary locking elements include locking elements provided on opposite lateral walls of each rack.

10. The magazine according to claim 1, wherein each rack is adapted to receive two holding plates, with the two holding plates being arranged next to each other.

11. The magazine according to claim 1, wherein the complementary elements includes two locking elements provided on at least one lateral side of each rack and arranged in the vicinity of respective corners of the rack.

12. The magazine according to claim 11, wherein each holding plate has locking means cooperating with corresponding locking means provided on each rack between the two locking elements for connecting the holding plate with the rack.

13. The magazine according to claim 1, wherein at least one of the racks and the holding plate are manufactured from a material selected from a group consisting of polypropylene, polyethylene, polymethacrylate, and polycarbonate.

* * * * *